US007322716B1

(12) United States Patent
Atkinson

(10) Patent No.: US 7,322,716 B1
(45) Date of Patent: Jan. 29, 2008

(54) EXTENDABLE ARTICULATED FLASHLIGHT

(76) Inventor: Richard Warren Atkinson, P.O. Box 515, Pageland, SC (US) 29728

( * ) Notice: Subject to any disclaimer, the term of this patent is extended or adjusted under 35 U.S.C. 154(b) by 0 days.

(21) Appl. No.: 11/535,997

(22) Filed: Sep. 28, 2006

(51) Int. Cl.
*F21L 4/04* (2006.01)

(52) U.S. Cl. ..... 362/198; 362/419

(58) Field of Classification Search ..... 362/198
See application file for complete search history.

(56) References Cited

U.S. PATENT DOCUMENTS 1,369,719 A * 2/1921 Stenvall ..... 362/413
1,591,791 A * 7/1926 Sprout ..... 248/123.2
1,692,394 A 11/1928 Sundh
2,434,986 A * 1/1948 Bremer ..... 362/421
2,466,722 A * 4/1949 John ..... 248/278.1
2,648,762 A 8/1953 Dunkelburger
2,917,619 A * 12/1959 Petrick ..... 362/8
3,994,464 A * 11/1976 Perbal et al. ..... 248/280.11
4,317,162 A 2/1982 Richards et al.
4,495,550 A 1/1985 Visciano
4,554,620 A * 11/1985 Warshawsky ..... 362/269
4,586,117 A * 4/1986 Collins ..... 362/373
4,772,993 A * 9/1988 Engel ..... 362/419
5,016,153 A * 5/1991 Gismondi et al. ..... 362/402
5,025,353 A * 6/1991 Menaged ..... 362/98
5,088,014 A * 2/1992 Boughey ..... 362/132
5,143,333 A * 9/1992 Warden ..... 248/123.11
5,154,483 A 10/1992 Zeller
5,158,361 A * 10/1992 Huang ..... 362/414
5,265,000 A * 11/1993 Lin ..... 362/413
5,333,103 A * 7/1994 Cvek ..... 362/413
5,369,556 A 11/1994 Zeller
5,422,802 A * 6/1995 Lin ..... 362/269
5,906,426 A 5/1999 Farrington et al.
6,592,241 B1 * 7/2003 Kovacik et al. ..... 362/419
7,073,926 B1 * 7/2006 Kremers et al. ..... 362/419
7,104,512 B2 * 9/2006 Wolf et al. ..... 248/276.1
7,156,541 B2 * 1/2007 Yeung ..... 362/418
7,248,402 B2 * 7/2007 Obrebski et al. ..... 359/368
2003/0072157 A1 * 4/2003 Noland et al. ..... 362/245

* cited by examiner

*Primary Examiner*—Hargobind S. Sawhney
(74) *Attorney, Agent, or Firm*—F. Rhett Brockington

(57) ABSTRACT

The invention is an apparatus that is an extendable articulated flashlight. The apparatus have an electric power source; a housing for the electric power source, where the housing has a base; a light generating device; and an adjustable extendable collapsible arm connected to the housing and to the light generating device. The housing can additionally have a compartment for tools and a handle. In the invention, the collapsible arm and light generating device have a combined weight that is less than a total weight of the housing and an electric power source if the electric power source is contained in the housing. The housing acts a ballast that stabilizes the light generating device, so that the adjustable extendable collapsible arm can be fully extended in any direction, and the light will retain its position.

17 Claims, 6 Drawing Sheets

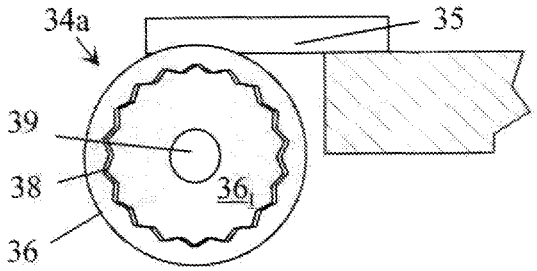
FIG. 7a
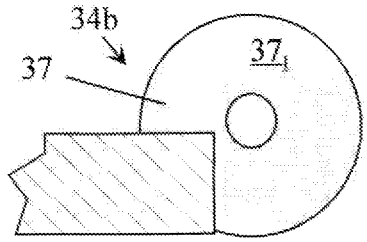
FIG. 7b
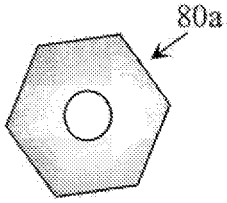
FIG. 8a
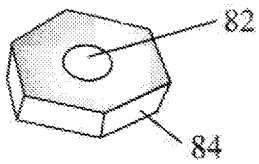
FIG. 8a'
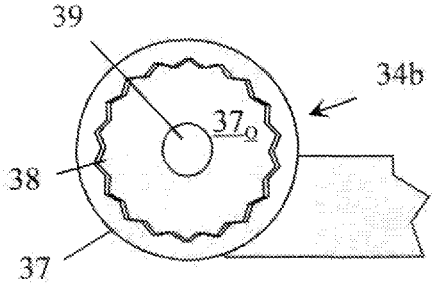
FIG. 7b'
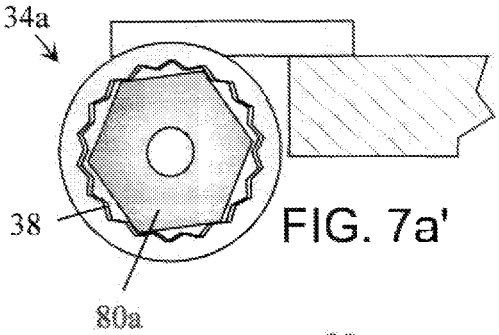
FIG. 7a'
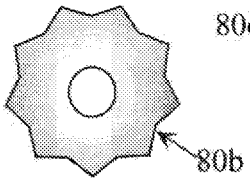
FIG. 8b
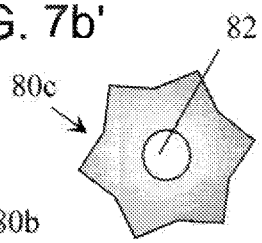
FIG. 8c
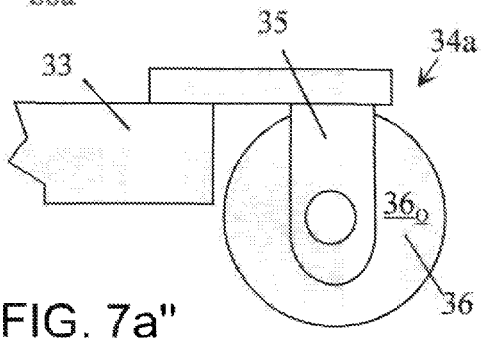
FIG. 7a"
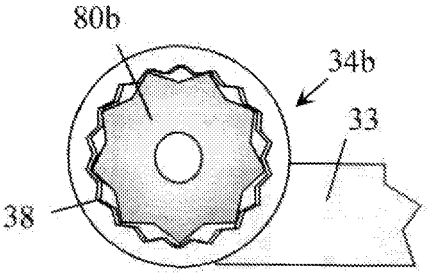
FIG. 7b"

EXTENDABLE ARTICULATED FLASHLIGHT

BACKGROUND OF THE INVENTION

1. Filed of the Invention

The invention relates generally to flashlights, and more particularly to a light on an articulating collapsible extendable arm that has a housing with a base of sufficient ballast that the light can be extended and directed in substantially any direction, and remain in that position.

2. Prior Art

U.S. Pat. No. 2,648,762 to M. S. Dunkelburger teaches a *Combined Housing and Flexible Flashlight Support*, wherein the light and reflector are supported on one end by a flexible conduit and on the other end by the battery casing.

U.S. Pat. No. 1,692,394 to A. Sundh teaches a similar flashlight, where the flexible conduit appears to be wound on a spool. The flexible conduit is an extendible, flexible, adjustable neck. U.S. Pat. No. 1,692,394 patent teaches a larger battery in a case.

U.S. Pat. No. 5,906,426 to Farrington, et al. teached a light with a flexible support and reduced storage length. The invention is similar to the Black & Decker® snake light. A variation of the snake light is taught in U.S. Pat. No. 4,495,550.

U.S. Pat. No. 4,495,550 to Visciano teaches a *Flexible Flashlight*, which has a flexible conduit neck.

Noel E. Zeller, of Zelco Industries, has two patents U.S. Pat. No. 5,369,556, a *Radiant-energy tool with Flexible Extension*; and U.S. Pat. No. 5,154,483, a *Flashlight with Flexible Extension*. These patents also have the additional feature that they have a butane flame for igniting a fire.

U.S. Pat. No. 4,317,162 to Richards, et al., teaches a battery operated luminaire with emergency switching means. The light is on a flexible neck and there is big battery, but the neck is not supporting.

The prior art has a number of examples of flexible conduit for flashlights and lamps, however a limitation with flexible conduit is that it cannot extend very far, particularly in the horizontal direction, before it bends under its own weight. Furthermore, flexible conduit does not readily collapse into a compact space, as its capability of being adjusted in many directions also makes it difficult to fold neatly. What is needed is a light that can be extended by a user to positions beyond that of traditional flashlights having flexible conduit. The invented flashlight would eliminate the need for a second person to "hold the light" while the user's hands are free to perform a task. The light needs to be adjustable, at least comparable to the flexible conduit lamps of the prior art, but additionally it must have an improved extending mechanisms that can support more weight and therefore extend further.

SUMMARY OF THE INVENTION

The invention is an apparatus that is an extendable articulated flashlight. The apparatus comprises an electric power source; a housing for the electric power source, where the housing has a base; a light generating device; and an adjustable extendable collapsible arm connected to the housing and to the light generating device. The housing can additionally be further comprised of a compartment for tools and a handle. In the invention, the collapsible arm and light generating device have a combined weight that is less than a total weight of the housing and an electric power source, where the electric power source is contained in the housing.

The housing (including its contents) acts as a ballast that stabilizes the light generating device, so that even when the adjustable extendable collapsible arm is fully extended in any direction, for instance horizontally, there is enough ballast to stabilize the arm and the light. The housing can further comprise a base to provide additional ballast. The adjustable extendable collapaislbe arm is comprised of a series of foldable articulating elements linked end-to-end via rotating joints having substantially equal or incrementally higher resistance to rotation as measured from the light generating device to the housing, where the resistance to rotation of a specified joint is higher than an extension weight, and where the extension weight is the combined weight of the light generating device and the sum of articulating elements extending beyond the specified joint.

The invented articulating element provides several advantages over a conventional flexible conduit. The location of articulation or rotation is at one or both ends of a substantially rigid element, so that the substantially rigid element can be moved by the user in a manner not dissimilar to a wrench. The wrench has a mechanical advantage (i.e. its length) that enabled the user to apply a significant rotational force at the point of rotation (i.e. the point of articulation). This is in contrast to flexible conduit, where substantially every linkage is close to the adjacent linkage, and there is very little mechanical advantage, and it is difficult for a user to apply a significant rotational force at the point of articulation. The invented series of foldable articulating elements can have a relatively high resistance to rotation, and therefore an ability to extend further than heretofore invented extendable flashlights. Because of the mechanical advantage the user can still easily collapse or extend the adjustable extendable collapsible arm, even through the joint can have a relatively high resistance to rotation.

The resistance to rotation is generated using mechanical brakes or magnetic brakes, or a combination thereof, and is described below.

BRIEF DESCRIPTION OF THE DRAWINGS

The present invention is illustrated and described herein with reference to various figures, in which like references denote like components and/or parts, and in which:

FIGS. 7*a* and 7*a'* are partial sectional side views taken along sectional line 7-7 of the second half joint, as seen from the bottom of the page;

FIG. 7*a"* is a partial sectional side view taken along sectional line 7-7 of the second half joint illustrated in FIGS. 7*a* and 7*a'*, as seen from the top of the page;

FIG. 7*b* is a partial sectional side view taken along sectional line 7-7 of the first half joint, as seen from the bottom of the page;

FIGS. 7*b'* and 7*b"* are partial sectional side views taken along sectional line 7-7 of the second half joint illustrated in FIG. 7*b*, as seen from the top of the page;

FIG. 8*a* is a frontal view of a hexagonal magnetic brake pad;

FIG. 8*a'* is a perspective view of the hexagonal magnetic brake pad illustrated in FIG. 8*a;*

FIG. 8*b* is a frontal view of a nine-sided star magnetic brake pad;

FIG. 8*c* is a frontal view of a six-sided star magnetic brake pad;

DETAILED DESCRIPTION OF THE INVENTION

Figure 1:
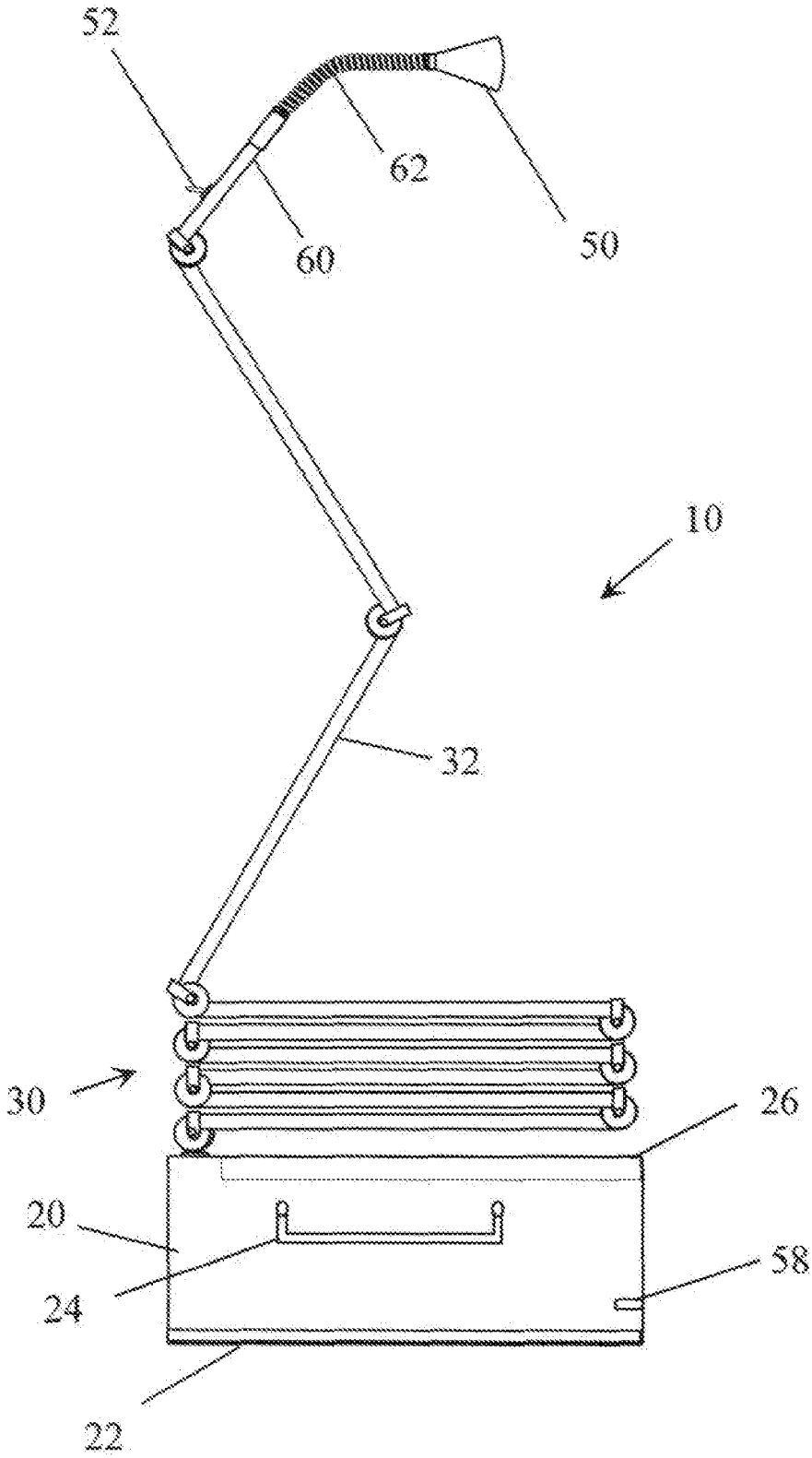
FIG. 1 is a side view of the invented apparatus that is an articulated flashlight, wherein the collapsible arm is partially extended.

The invention is an apparatus that is an extendable articulated flashlight 10. The apparatus in a preferred embodiment is comprised of a housing 20 having a base 22, a light generating source 50, an adjustable extendable collapsible arm 30 connected to the housing 20 and to the light generating device 50, and an electric power source. The power source can be a battery(s) seated in the housing, a component of the light generating device, an external power source, or any combination thereof. In FIG. 1, the electric power source is comprised of rechargeable batteries located in the housing. The batteries can be recharged through electrical port 58. The batteries in addition to serving as a source of electrical energy, have a weight, and their weight adds to the total ballast. The invention is not limited to the position of the power source, as its weight can be compensated for utilizing a base having additional weight. The collapsible arm and light generating device have a combined weight that is less than the total weight of the housing including the weight of the electric power source, if present in the housing. The combined weight is a ballast that stabilizes the light generating device when the adjustable extendable collapsible arm is fully extended in any direction. The adjustable extendable collapsible arm comprises a series of foldable articulating elements 32 linked end-to-end via rotating joints having substantially equal or incrementally higher resistance to rotation, wherein the resistance increases as the joints are closer to the hosing. The resistance to rotation of a specified joint is higher than an extension weight, where the extension weight is the combined weight of the light generating device and the sum of articulating elements extending beyond the specified joint. The housing 20 can also have a compartment 26, for storing tools and the like, and a handle 24 suitably positioned to carry the extendable articulated flashlight 10. There is a switch 52 to control the light 50. The light 50 is selected from the group consisting of incandescent lamps and the like, fluorescent lamps, halogen lamps, LEDs, lasers, and illuminated fiber optic cable. A conventional flashlight bulb or flashlight LEDs are preferred for most applications. The light generating device 50 can also have variable control, such as multi-position switch or a rheostat, which provides adjustable control over the intensity of the light emitting from the source.

The apparatus preferably also has a hybrid articulating element 60 comprised of a half joint and terminated with an adjustable obedient linkage 62, where the adjustable obedient linkage is connected to the light generating device therein providing additional degrees of freedom of a movement, and the half joint is linked to the series of foldable articulating elements 30. The adjustable obedient linkage 62 is flexible conduit and the like, sometimes known as gooseneck tubing. The adjustable obedient linkage 62 enables the light 50 to be adjusted to almost any position. The flexible conduit is selected to have sufficient resistance to movement to support itself and the light generating device.

Figure 2:
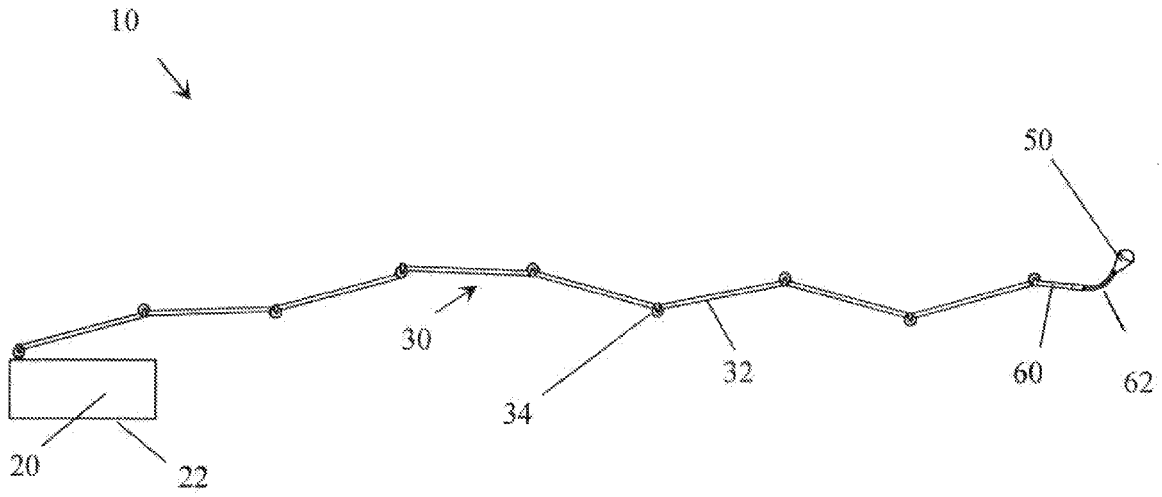
FIG. 2 is a side view of the apparatus illustrating the collapsible arm fully extended substantially horizontally, wherein the light is rotated so that it is directed upwards.
Figure 3:
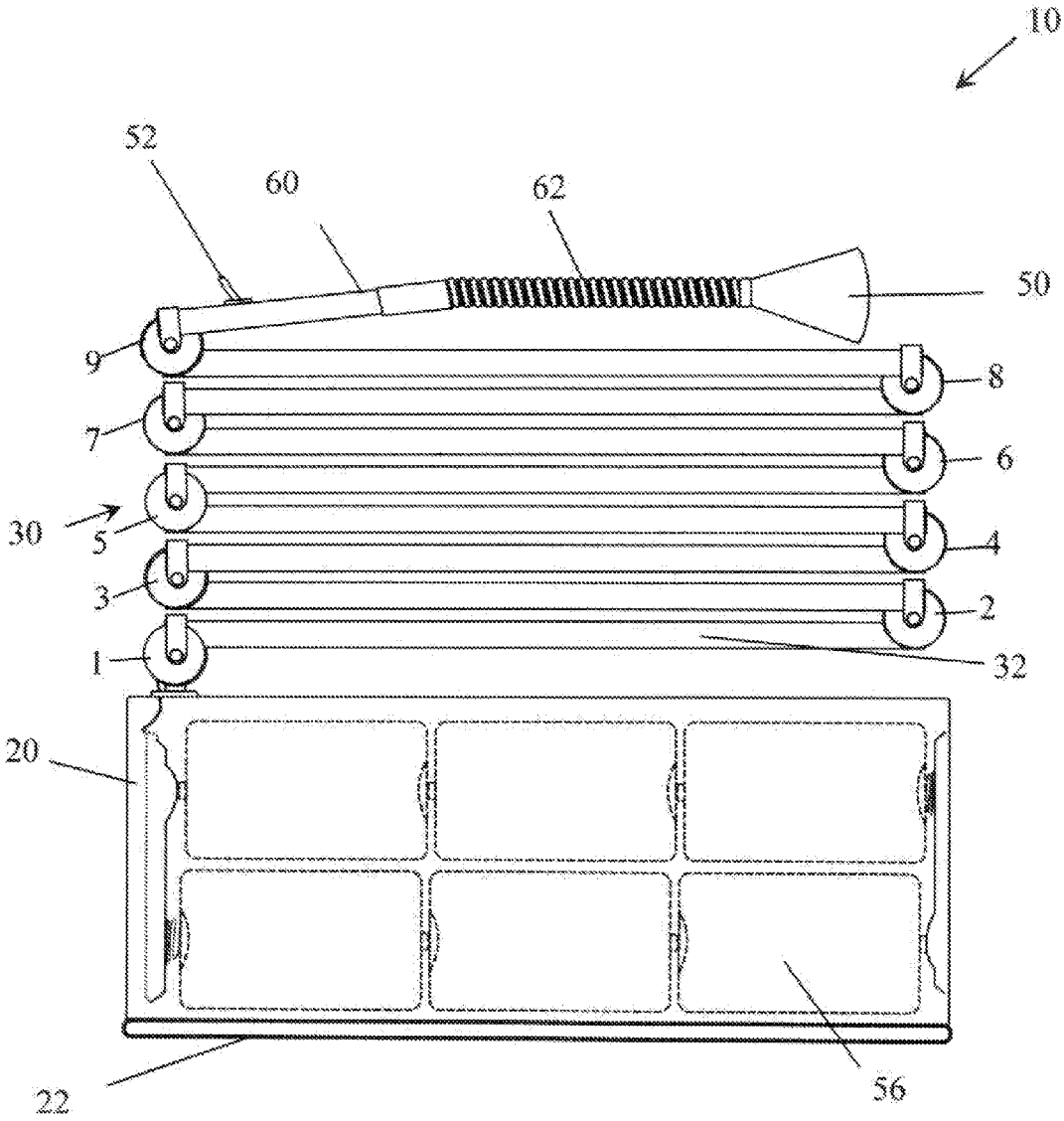
FIG. 3 is a side view of the apparatus illustrating the articulating elements fully collapsed, and, shown in ghost, is the electric power source which is a set of batteries.

The ballast, as illustrated in FIG. 2, is sufficient such that the collapsible arm can be fully extended even in the horizontal position. Notice the that the light 50 is rotated so that it is directed upwards. If each articulating element is 8 inches long, the collapsible arm 30 can readily extend 6 feet, as the joints 34 have a reality high resistance to rotation. FIG. 3 illustrates that when the articulating elements are fully collapsed they are substantially parallel to each other, and either touching or near touching. The electric power source 56 in the illustrated embodiment is comprised of batteries seated in the housing, and they are shown in ghost, as indicated by the dashed lines.

Figure 5:
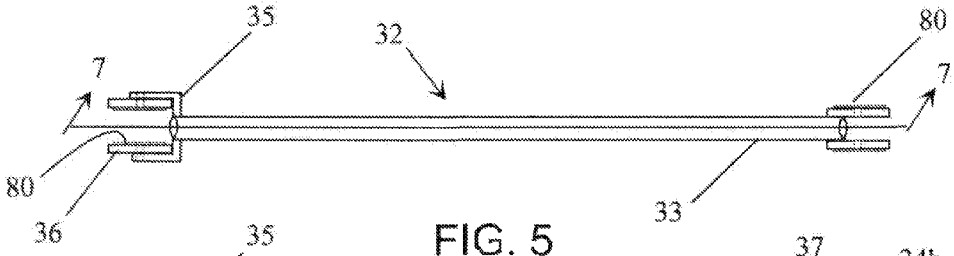
FIG. 5 is an overhead view of an articulating element, wherein the elongate strength member has a first end with a first half joint comprised of a pair of oppositely facing inner vertical plates on opposing sides of the strength member, and an opposing end that has a two leg forked extension with a second half joint comprised of a pair of oppositely facing outer vertical plates, where one outer vertical plate is on one leg of the forked extension and the other vertical plate is on the other leg of the forked extension.
Figure 4:
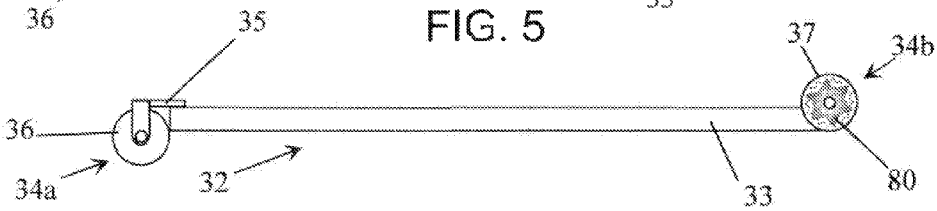
FIG. 4 is a side view of an articulating element with magnetic brakes having an elongate strength member having a first end with a first half joint comprised of an inner vertical plate, and an opposing end with a second half joint comprised of an outer vertical plate.

The resistance to rotation is generated using mechanical brakes or magnetic brakes. The brakes are an integral component of all the articulating elements. FIGS. 4, 5, and 7 illustrate articulating elements with magnetic brakes. Articulating element 32 comprises an elongate strength member 33 having a first end with a first half joint 34*b* comprised of an inner vertical plate 37, and an opposing end with a second half joint 34*a* comprised of an outer vertical plate 36. The inner vertical plate 37 has an inside face $\mathbf{37}_I$ and an outside face $\mathbf{37}_O$ with an orthogonal bearing axial hole 39 that extends from the inside face to the outside face, where the outside face $\mathbf{37}_O$ has an engaging wrench-like recessed area 38 that is substantially centered on the inner plate's axial hole 39. Inner magnetic braking pad 80 (either 80*a*, 80*b* and 80*c*) is comprised of a permanent magnet or magnetizable material, and has an annual hole 82 that is co-axial with the inner plate's axial hole. Magnetic braking pad 80 (either 80*a*, 80*b* or 80*c*) is intersectinlgy engaged by the wrench-like recessed area 38 on the outside face $\mathbf{37}_O$ of the inner vertical plate 37, so that rotation of the inner vertical plate causes rotation of the inner magnetic brake pad and, likewise, resistance to rotation by the inner magnetic brake pad 80 causes braking of the inner vertical plate. In the FIG. 7*b"* magnetic brake 80*b* is illustrated, but as will be explained below, all three of the illustrated magnetic brakes 80*a*, 80*b* or 80*c* will fit in the recessed area 38, and depending on the desired level of braking the appropriate magnetic brake pad is selected. Outer vertical plate 36 has an inside face $\mathbf{36}_I$ and an outside face $\mathbf{36}_O$ with an orthogonal bearing axial hole 39 that extends from the outside face to the inside face. The inside face of the outer vertical plate 36 has a wrench-like recessed area 38 that is substantially centered on the outer plate's axial hole. Note, the recessed areas 38 and the orthogonal bearing axial hole 39 have the seam size diameter. The inner and outer vertical plates also have substantially the same dimensions. Like the inner vertical plate, the outer vertical plate 36 has a magnetic braking pad 80*a*. Magnetic braking pad 80*a* is illustrated, but depending on the desired level of braking it could be 80*b* or 80*c*. The magnetic braking pad is comprised of permanent magnet or magnetizable material, and has an annular hole 82, as shown in FIGS. 8*a'* and 8*c*, where the annular hole 82 is co-axial with the outer plate's axial hole. Similarly, the hexagonal braking pad 80*a* is intersectingly engaged by the wrench-like recessed area 38 of the inside face 36$_I$ of the outer vertical plate 36, so that rotation of the outer vertical plates causes rotation of the outer magnetic brake pad and, likewise, resistance to rotation by the outer magnetic brake pad causes braking of the outer vertical plate 36. The magnetic braking pads have a thickness 84 that is greater that the depth of the recess area 38, so that the recessed area of the inner vertical plate cannot additionally intersectingly engage a paired magnetic braking pad in the opposing outer vertical plate when articulating elements are linked end-to-end.

Figure 6:
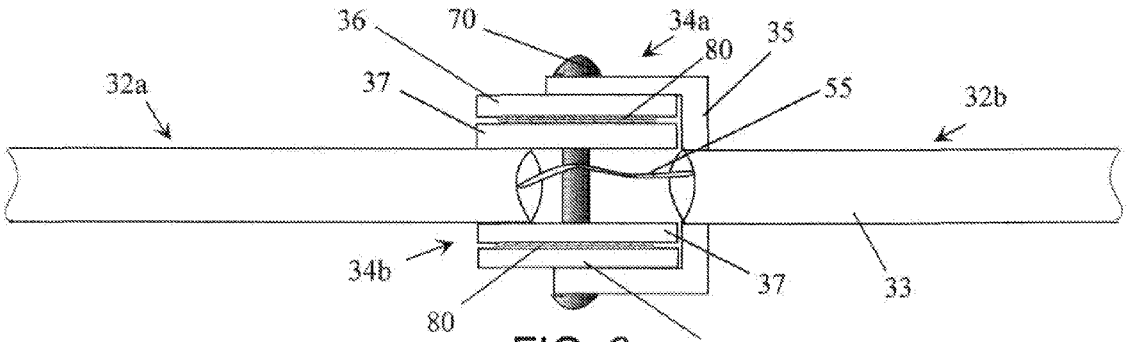
FIG. 6 is an overhead partial view of two articulating elements illustrated in FIG. 5, that are linked and braked.

Joints are braked because, as shown in FIG. 6, the magnetic braking pad are mounted so as to be magnetically attracted to each other. The magnet braking pads generally have a smooth face so that once rotation is started, the paired pads rub against each other with a substantially continuous level of resistance. If, however, more resistance is required the magnetic braking pads can be selected that have interlocking ridges and the like, not dissimilar to the mechanical brakes that are discussed below. In the case of magnetic brake pads with smooth faces, the level of braking, or resistance to rotation, is substantially a partial function of the total friction weighted by the mechanical advantage of that friction. For any given two magnetic braking pad materials the total friction is dependent upon the level of magnetic attraction, (the greater the attraction the more the braking), the coefficient of friction between the two materials, and the surface area in contact. The braking effectiveness of the total friction is weighted by the mechanical advantage of the brake. The greater the distance that the frictional resistance is from the axis of rotation, the larger the braking mechanical advantage, and the more efficacious the brake. A brief inspection of the illustrated magnetic braking pads 80*a*, 80*b* and 80*c*, gives some clues as to which pads would generate the greatest resistance. Note first that the wrench-like recessed area 38 is comparable in shape to a box wrench having a plurality of points (i.e. 18 point box wrench). Therefore, if the magnetic pads have an integer number of sides divisible into the plurality of points, for instance 6 or 9 are integrally divisible into 18 points, then the pads will have at least one side which engages the points of the wrench-like recessed area. Generally speaking, the grater the number of sides, the higher the surface areas, so pad 80*b*, which has 9 sides, would have more surface area than pads 80*a* and 80*c*, which have 6 sides, and therefore pad 80*b* would have more braking ability. Pads 80*a* and 80*c* have the same number or sides, but the star shape of 80*c* has less surface area than hexagon 80*a*, and additionally less actual surface area located from the axial center than hexagon 80*a*. Therefore, hexagonal pad 80*a* would have more effective braking than star pad 80*c*, because it has a higher braking mechanical advantage and slightly more surface area. The braking effectiveness enables the articulating joints to be engineered to have substantially equal or incrementally higher resistance to rotation. Of course, in addition to the shape and the mechanical advantage, the level of magnetic attraction can also be greatly effected by the choice of materials used to make the magnetic pads, and whether there are coatings for intervening washers and the like are used, but the invention anticipates these refinements.

The resistance to rotation is advantageously incremental. If the reinstate to rotation of a specified joint is higher than an extension weight, and the joints near the light can be tailored to articulate easier than the joints near the housing. This incremental resistance makes it easier to collapse the arm, and to extend the arm such that only those articulating elements 32 that are needed for a task are pulled off the housing.

In the illustrated embodiment shown in FIGS. 5 and 6, the articulating element 32 is an elongate strength member 33 having a first end with a first half joint 34*b* comprised of a pair of opposiely facing inner vertical plates 37 on opposing sides of the strength member, and an opposing end that has two leg forked extension 35 with a second half joint 34*a* comprised of a pair of oppositely facing outer vertical plates 36, where one outer vertical plate is on one leg of the forked extension and the other vertical plate is on the other leg of the forked extension. The articulating element with ends having pairs of vertical plates doubles the potential resistance to rotation and adds significant strength to the joint. Like the single plate joints each said inner vertical plate has an inside face and an outside face with an orthogonal bearing axial hole that extends from the inside face to the outside face, where the outside face has an engaging wrench-like recessed area that is substantially centered on the inner plate's axial hole, and an inner magnetic braking pad comprised of a permanent magnet or magnetizable material, and having an annular hole that is co-axial with the inner plate's axial hole. The magnetic braking pad is intersectingly engaged by the wrench-like recessed area on the outside face of the inner vertical plate, so that rotation of the inner vertical plate causes rotation of the inner magnetic brake pad and, likewise, resistance to rotation by the inner magnetic brake pad causes braking of the inner vertical plate; and each outer vertical plate has an inside face and an outside face with an orthogonal bearing axial hole that extends from the outside face to the inside face, where the inside face has a wrench-like recessed area that is substantially centered on the outer plate's axial hole, and an outer magnetic braking pad comprised of permanent magnetic or magnetizable material with an annular hole that is co-axial with the outer plate's axial hole. The braking pad is intersectingly engaged by wrench-like recessed area of the inside face of the outer vertical plate, so that rotation of the outer vertical plate causes rotation of the outer magnetic brake pad and, likewise, resistance to rotation by the outer magnetic brake pad causes braking of the outer vertical plate. There is an axial rod 70 that links the first half joint of one articulating element 32*a* to the second half joint of another articulating element 32*b*.

In the illustrated embodiment electrical power is conveyed from batteries 56 as shown in FIG. 3 to the light 50 via an electrical wire 55, which is threaded through the core of the articulating elements, which are substantially tubular in shape. As previously discussed the batteries could also be a component of the light generating source, or the electrical source could be an external power source, like a drop-cord.

In the illustrated embodiment, as shown in FIG. 3, the apparatus 10 has a collapsible arm 30 with 9 joints, where it is desired that joint 1, which attaches the collapsible arm 30 to the housing 20, would preferably have the greatest braking, and joint 9 connecting the collapsible arm 30 to the hybrid articulating element 60 with the flexible conduit would preferably have the least braking. As previously discussed the drawings illustrate three magnetic braking pads 80*a*, 80*b* and 80*c*, where all things being equal one would expect the braking ability to be 80*b*>80*a*>80*c*. Assigning some value, let us assume that the braking resistance of 80*b*=5, 80*a*=4, and 80*c*=3. If the magnetic braking pads are paired, such that there are two pair per joint, then joint 1 should have two pair of 80*b* magnetic braking pad, for a total braking resistance of 20 (i.e. 5+5+5+5=20); joint 2 would have a pair of 80*b* and a pair consisting of 80*b* and 80*a* for a total braking resistance of 19; joint 3 would have two pairs consisting of 80*b* and 80*a* a total braking resistance of 18; joint 4 would have a pair consisting of 80*a* and 80*b* and a pair consisting of 80*b* and 80*c* a total braking resistance of 17; joint 5 would two pairs consisting of 80*a* and 80*a* for a total braking resistance of 16; point 6 would have a pair of 80*a* and a pair consisting of 80*a* and 80*c* for a total braking resistance of 15; joint 7 would have two pairs consisting of 80*a* and 80*c* for a total braking resistance of 14; joint 8 would have a pair of 80*c* and a pair consisting of 80*c* and 80*a* a total braking resistance of 13; and joint 9 would have two pairs of 80*c* for a total barking resistance of 12. The invented articulated flashlight enables precise incremented control over the rotational resistance of each joint. It follows that this scheme of pairing magnetic braking pads could be extended to other applications.

Figure 11:
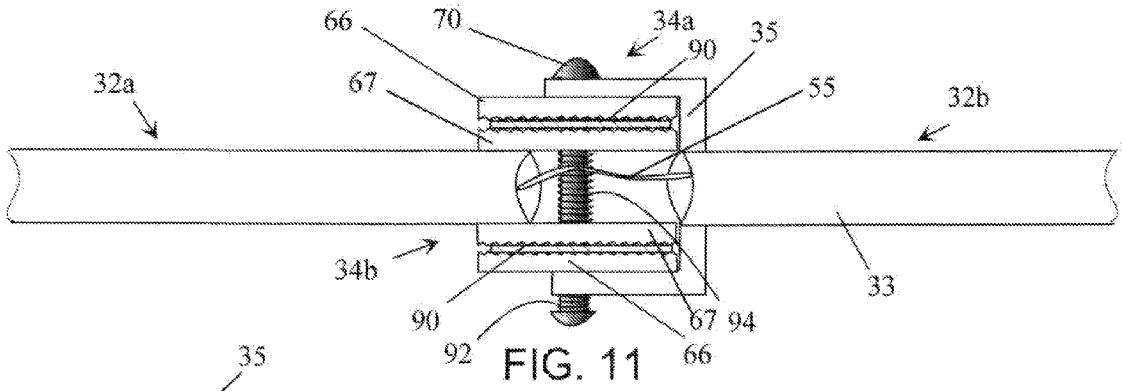
FIG. 11 is an overhead partial view of two articulating elements illustrated in FIG. 9, that are linked and mechanically braked.
Figure 10:
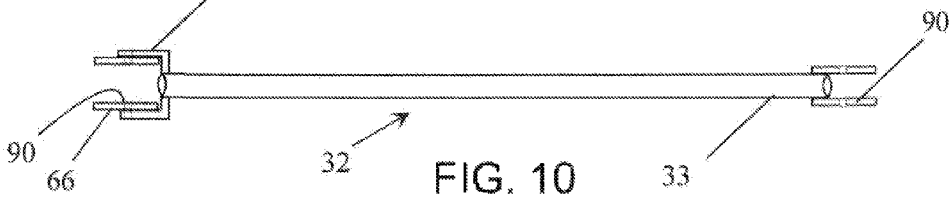
FIG. 10 is an overhead view of the articulating element illustrated in FIG. 9.
Figure 9:
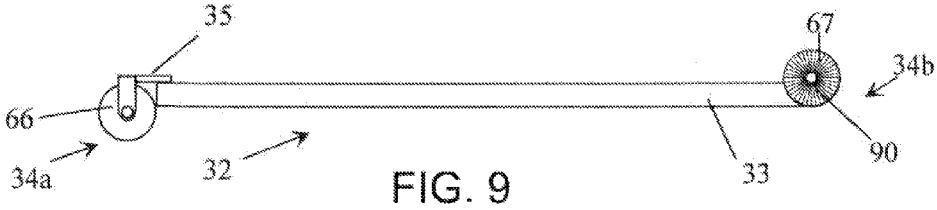
FIG. 9 is a side view of an articulating element than is similar to the articulating element illustrated in FIG. 4, except that the articulating element has mechanical spring loaded brakes with frictional and intermeshing surfaces.

The articulating element can alternatively have joints that are mechanically braked, and FIGS. 9-11 illustrates a mechanical brake that is a mechanical spring loaded brake with frictional and intermeshing surfaces. The articulating element 32 is comprised of an elongate strength member 33 having a first end with a first half joint 34*b* comprised of an inner vertical plate 67, and an opposing end with a second half joint 34*a* comprised of an outer vertical plate 66. The inner vertical plate 67 has an inside face and an outside face with an orthogonal bearing axial hole that extends from the inside face to the outside face, where the outside face has an engaging radially ridged area 90 that is substantially centered on the inner plate's axial hole, so that rotation of the inner vertical plate causes the radially ridged area 90 to act as part of a brake. The outer vertical plate 66 has an outside face and an inside face with an orthogonal bearing axial hole that extends from the outside face to the inside face, where the inside face has an engaging radially ridgded area 90 that is substantially centered on the inner plate's axial hole, so that portion of the outer vertical plate 66 causes the radially ridged area to act as part of a brake. As illustrated in FIG. 11, there are preferably a pair of outer vertical plates 66 having a radially ridged area than are individual legs of a two leg forked extension 35, and a pair of inner vertical plates 67 having a radially ridged area. The pair of inner vertical plates 67 are spring loaded with inner sprig 94, and the pair of outer vertical plates 66 are spring loaded with outer spring 92. Springs 92, 94 are aligned on axial rod 70 that links and maintains pressure between the first half joint 34*a* of one articulating element 32*a* to the second half joint 34*b* of anther articulating element 32*b*. In further adaptations of the mechanical brakes, there can be interleaving rubber pads between the radially ridged areas of the plates. It is also anticipated that the mechanical brakes can be disc, drum brakes and the like, and that the braking resistance can be incremental or substantially equal.

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the present invention and are intended to be covered by the following claims.

What is claimed is:

1. An apparatus than is an extendable articulated flashlight, said apparatus comprising:

an electric power source;

a housing for the electric power source, said housing having a base;

a light generating device; and an adjustable extended collapsible arm connected to the housing and to the light generating device, said collapsible arm and light generating device having a combined weight that is less than a total weight of the housing and the electric power source, wherein the combined weight of the housing and electric power source is a ballast that stabilizes the light generating device when the adjustable expendable collapsible arm is fully expended in any direction, where said adjustable expandable collapsible arm comprises a series of foldable articulating elements linked end-to-end via rotating joints having substantially equal or incrementally higher resistance to rotation as measured from the light generating device to the housing, where the resistance to rotation of a specified joint is higher than an extension weight, where the extension weight is the combined weight of the light generating device and the sum of articulating elements extending beyond the specified joint; wherein any given articulating element comprises:

an elongate strength member having a first end with a first half joint comprised of an inner vertical plate, and an opposing end with a second half joint comprised of an outer vertical plate, where said inner vertical plate has an inside face and an outside face with an orthogonal bearing axial hole that extends from the inside face to the outside face, where the outside face has an engaging wrench-like recessed area than is substantially centered on the inner plate's axial hole, and an inner magnetic braking pad comprised of a permanent magnet or magnetizable material, and having an annular hole that is co-axial with the inner plate's axial hole, said magnetic braking pad being intersectingly engaged by the wrench-like recessed area on the outside face of the inner vertical plate, so that rotation of the inner vertical plate causes rotation of the inner magnetic brake pad and, likewise, resistance to rotation by the inner magnetic brake pad causes braking of the inner vertical plate, where said outer vertical plate has an inside face and an outside face with an orthogonal bearing axial hole that extends from the outside face to the inside face, where the inside face has a wrench-like recessed area that is substantially centered on the outer plate's axial hole, and an outer magnetic braking pad comprised of permanent magnet or magnetizable material, and having an annular hole that is co-axial with the outer plate's axial hole, said braking pad being intersectingly engaged by wrench-like recessed area of the inside face of the ouster vertical plate, so that rotation of the outer vertical plate causes rotation of the outer magnetic brake pad and, likewise, resistance to rotation by the outer magnetic brake pad causes braking of the outer vertical plate; and an axial rod that links the first half joint of one articulating element to the second half joint of another articulating element.

2. The apparatus according to claim 1, wherein the resistance to rotation is a partial function of the total magnetic attraction between the inner face magnetic braking pad on one articulating element and the outer magnetic braking pad on a linked second articulating element.

3. The apparatus according to claim 2, wherein the outside and inside fade engaging wrench-like recessed areas are comparable in shape to a plurality of points of a box wrench.

4. The apparatus according to claim 3, wherein the magnetic braking pads have a thickness that is equal to or greater than the depth of the recessed area, have an integer number of sides divisible into the plurality of points, for instance 6 or 9 are intergerly divisible into 18 points, and have a side which engages the wrench-like recessed area.

5. The apparatus according to claim 4, where a high resistance to rotation is achieved by linkedly combining the inner and outer magnetic pads, where the paired magnetic pads have a strong magnetic attraction and a high level of friction.

6. The apparatus according to claim 4, where a low resistance to rotation is achieved by linkedly combining the inner and outer magnetic pads, where the paired magnetic pads have a weak magnetic attraction and a low level of friction.

7. An apparatus that is an extendable articulated flashlight, said apparatus comprising:

an electric power source;

a housing for the electric power source, said hosing having a base;

a light generating device; and an adjustable extendible collapsible arm connected to the housing and to the light generating device, said collapsible arm and light generating device having a combined weight that is less than a total weight of the housing and the electric power source, wherein the combined weight of the housing and electric power source is a ballast that stabilizes the light generating dvcie when the adjustable extendable collapsible arm is fully extended in any direction, where said adjustable extendable collapsible arm comprises a series of foldable articulating elements linked end-to-end via rotating joints having substantially equal or incrementally higher resistance to rotating as measured from the light generating device to the housing, where the resistance to rotation of a specified joint is higher than an extension weight, where the extension weight is the combined weight of the light generating device and the sum of articulating elements extending beyond the specified joint; and a hybrid articulating element comprised of a half joint and terminated with an adjustable obedient linkage, where the adjustable obedient linkage is connected to the light generating device therein providing additional degrees of freedom of a movement, and the half joint is linked to the series of foldable articulating elements.

8. The apparatus according to claim 7, wherein said apparatus further comprises:

an electrical switch, wherein said switch has variable control over an intensity of the light emitting from the light generating device.

9. The apparatus according to claim 8, wherein said light generating device is selected from the group consisting of incandescent lamps, fluorescent lamps, halogen lamps, LEDs, lasers, and illuminated fiber optic cable.

10. The apparatus according to claim 7, wherein the adjustable obedient linkage is flexible conduit, which can be turned through a range of horizontal and vertical directions, and where said flexible conduit has sufficient resistance to movement to support itself and the light generating device.

11. The apparatus according to claim 7, wherein said electric power source is batteries.

12. The apparatus according to claim 11, wherein said batteries are rechargable batteries.

13. The apparatus according to claim 12, wherein said apparatus is further comprised of a means to recharge batteries and a means to connect to an external electrical source.

14. The apparatus according to claim 7, wherein said housing has a compartment for tools.

15. The apparatus according to claim 7, wherein said housing has a handle.

16. An apparatus that is an extendable articulated flashlight, said apparatus comprising:

an electric power source;

a housing for the electric power source, said housing having a base;

a light generating device; and an adjustable extendable collapsible arm connected to the housing and to the light generating device, said collapsible arm and light generating device having a combined weight that is less than a total weight of the housing and the electric power source, wherein the combined weight of the housing and electric power source is a ballast that stabilizes the light generating device when the adjustable extendable collapsible arm is fully extended in any direction, where said adjustable extendable collapsible arm comprises a series of foldable articulating elements linked end-to-end via rotating joints having substantially equal or incrementally higher resistance to rotation as measured from the light generating device to the housing, where the resistance to rotation of a specified joint is higher than an extrnsion weight, where the extension weight is the combined weight of the light generating device and the sum of articulating elements extending beyond the specified joined; wherein any given articulating element comprises:

an elongate strength member having a first end with a first half joint comprised of a pair of oppositely facing inner vertical plates on opposing sides of the strength member, and an opposing end that has a two leg forked extension with a second half joint comprised of a pair of oppositely facing outer vertical plates, where one outer vertical plate is on one leg of the forked extension and the other vertical plate is on the other leg of the forked extension, where each said inner vertical plate has an inside face and outside face with an orthogonal bearing axial hole that extends from the inside face to the outside face, where the outside face has an engaging wrench-like recessed area that is substantially centered on the inner plate's axial hole, and an inner magnetic braking pad comprised of a permanent magnetic or magnetizable material, and having an annular hole that is co-axial with the inner plate's axial hole, said magnetic braking pad being intersectingly engaged by the wrench-like recessed area on the outside face of the inner vertical plate, so that rotation of the inner vertical plate causes rotation of the inner magnetic break pad and, likewise, resistance to rotation by the inner magnetic brake pad causes braking of the inner vertical plate, where each said outer vertical plate has an inside face and an outside face with an orthogonal bearing axial hole that extends from the outside face to the inside face, where the inside face has a wrench-like recessed area that is substantially centered on the outer plate's axial hole, and an outer magnetic braking pad comprised of permanent magnet or magnetizable material, and having an annular hole that is co-axial with the outer plate's axial hole, said braking pad being intersectingly engaged by wrench-like recessed area of the inside face of the outer vertical plate, so that rotation of the outer vertical plate causes rotation of the outer magnetic brake pad and, likewise, resistance to rotation by the outer magnetic brake pad causes braking of the outer vertical plate; and an axial rod that links the first half joint of one articulating element to the second half joint of another articulating element.

17. An apparatus that is an extendable flashlight, said apparatus comprising:

an electric power source;

a housing for the electric power source, said housing having a base;

a light generating device;

an adjustable extendable collapsible arm connected to the housing and to the light generating device, said collapsible arm comprised of a series of foldable articulating elements linked end-to-end via rotating joints having substantially equal or incrementally higher resistance to rotation as measured from the light generating device to the housing, where the resistance to rotation of a specified joint is higher than an extension weight, where the extension weight is the combined weight of the light generating device and the sum of articulating elements extending beyond the specified joint, wherein the light generating device is supported by the expandable arm; and an electrical switch between the electric power source and the light generating device;

wherein any given articulating element is comprised of:

an elongate strength member having a first end with a first half joint comprised of an inner vertical plate, and an opposing end with a second half joint comprised of an outer vertical plate, where said inner vertical plate has an inside face and an outside face with an orthogonal bearing axial hole that extends from the inside face to the outside face, where the outside face has an engaging radially ridged area that is substantially centered on the inner plate's axial hole, so that rotation of the inner vertical plate causes the radially ridged area to act as part of a brake, where said outer vertical plate has an outside face and an inside face with an orthogonal baring axial hole that extends from the outside face to the inside face, where the inside face has an engaging radially ridged area that is substantially centered on the inner plate's axial hole, so that rotation of the outer vertical plate causes the radially ridged area to act as part of a brake; and an axial rod with a spring that links and maintains pressure between the first half joint of one articulating element to the second half joint of another articulating element.

* * * * *